US005234727A

United States Patent [19]

Hoberman

[11] Patent Number: 5,234,727

[45] Date of Patent: Aug. 10, 1993

[54] CURVED PLEATED SHEET STRUCTURES

[76] Inventor: Charles Hoberman, 472 Greenwich St., New York, N.Y. 10013

[21] Appl. No.: 732,979

[22] Filed: Jul. 19, 1991

[51] Int. Cl.[5] ..... A63H 33/16

[52] U.S. Cl. ..... 428/12; 428/181; 428/542.2; 446/488

[58] Field of Search ..... 428/9, 12, 181, 542.2, 428/542.8; 446/117, 487, 488

[56] References Cited

U.S. PATENT DOCUMENTS

| | | | |
|---|---|---|---|
| 2,922,239 | 1/1960 | Glynn, Jr. | 428/9 |
| 3,302,321 | 2/1967 | Walker | 428/12 X |
| 3,788,934 | 1/1974 | Coppa | 428/12 X |
| 3,894,352 | 7/1975 | Hooker | 428/12 X |
| 4,327,516 | 5/1982 | Lubozynski | 446/488 |
| 4,780,344 | 10/1988 | Hoberman | 428/12 |
| 4,981,732 | 1/1991 | Hoberman | 428/12 |

OTHER PUBLICATIONS

2D-Array Mission, American Institute of Aeronautics and Astronautics, Miura et al, pp. 363-368.

*Primary Examiner*—Henry F. Epstein

*Attorney, Agent, or Firm*—Sprung Horn Kramer & Woods

[57] ABSTRACT

Self-supporting structures of diverse shapes are disclosed that may be collapsed down to compact bundles. Structures of this type are comprised of units which are comprised of two strips having non-parallel pleat lines. By pleating these strips according to a special pleat pattern, these structures may collapse down and expand out in a smooth manner.

8 Claims, 15 Drawing Sheets

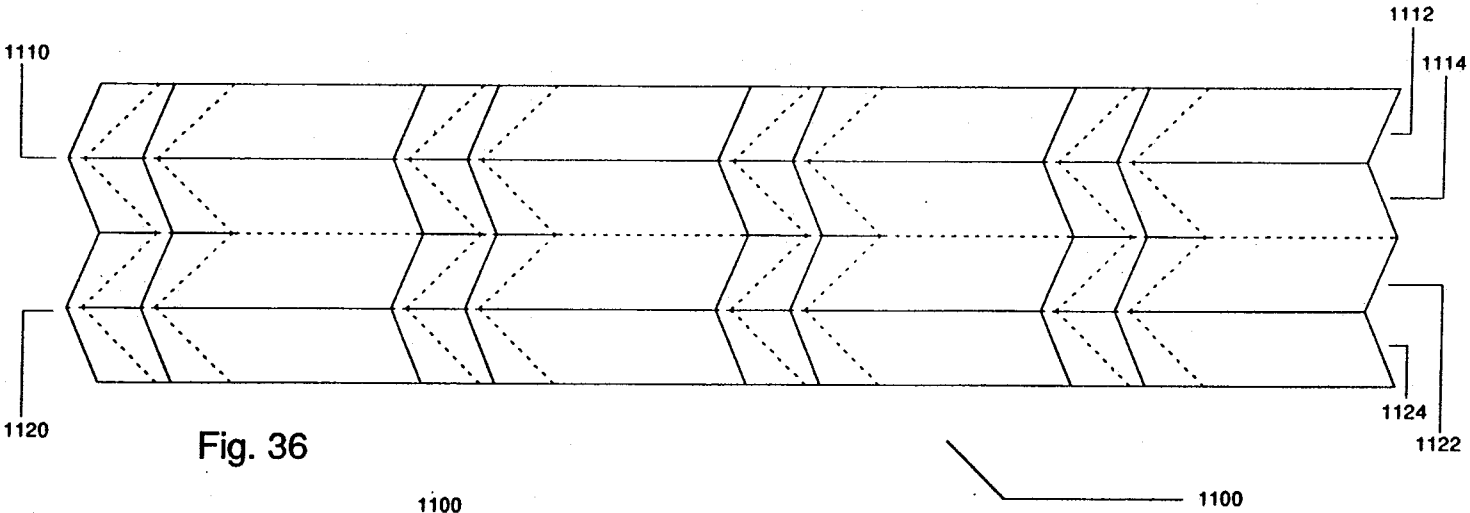
Fig. 36
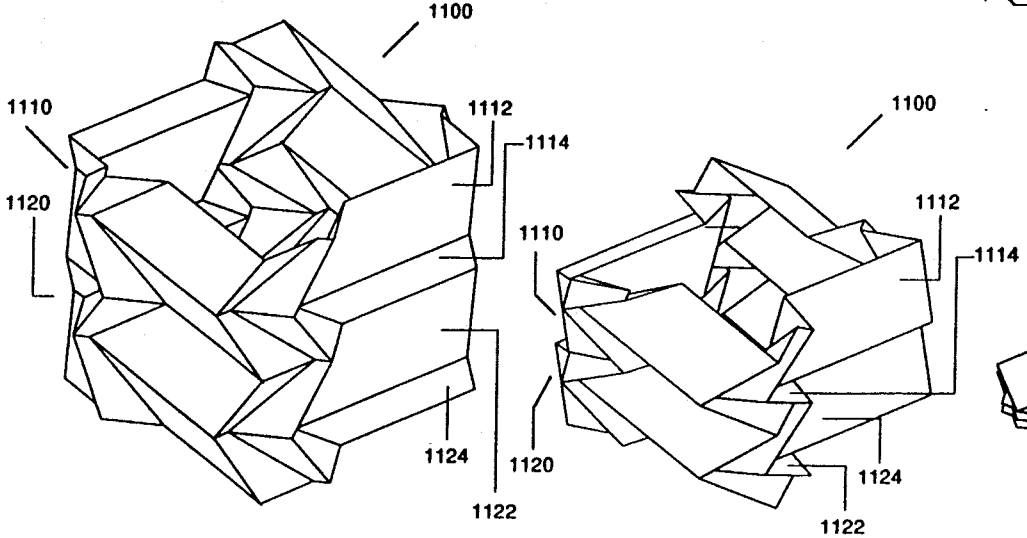
Fig. 37
Fig. 38
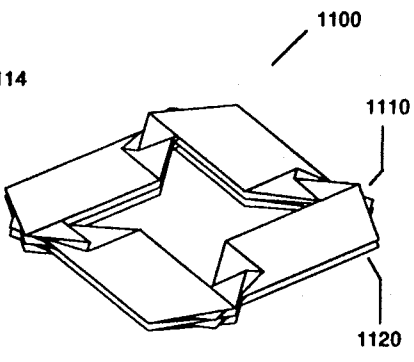
Fig. 39

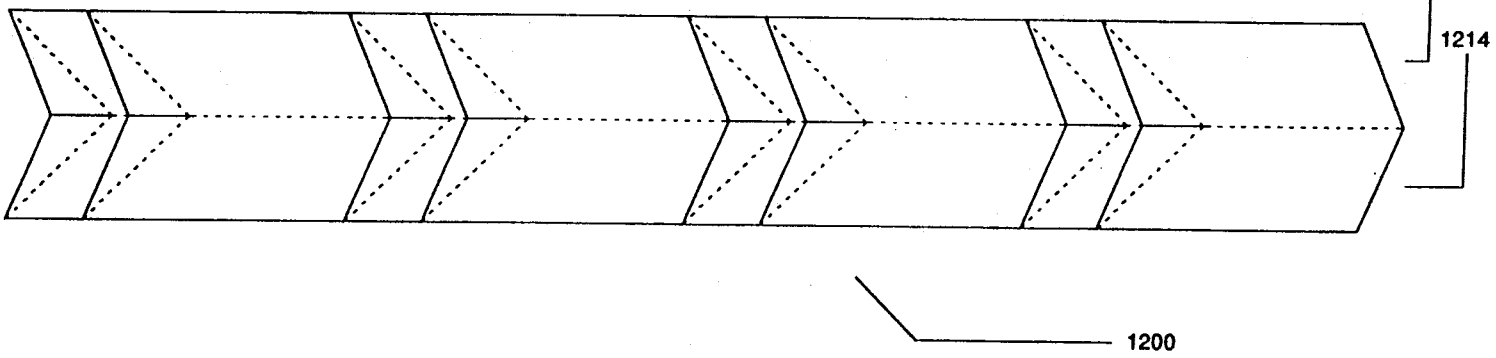
Fig. 40
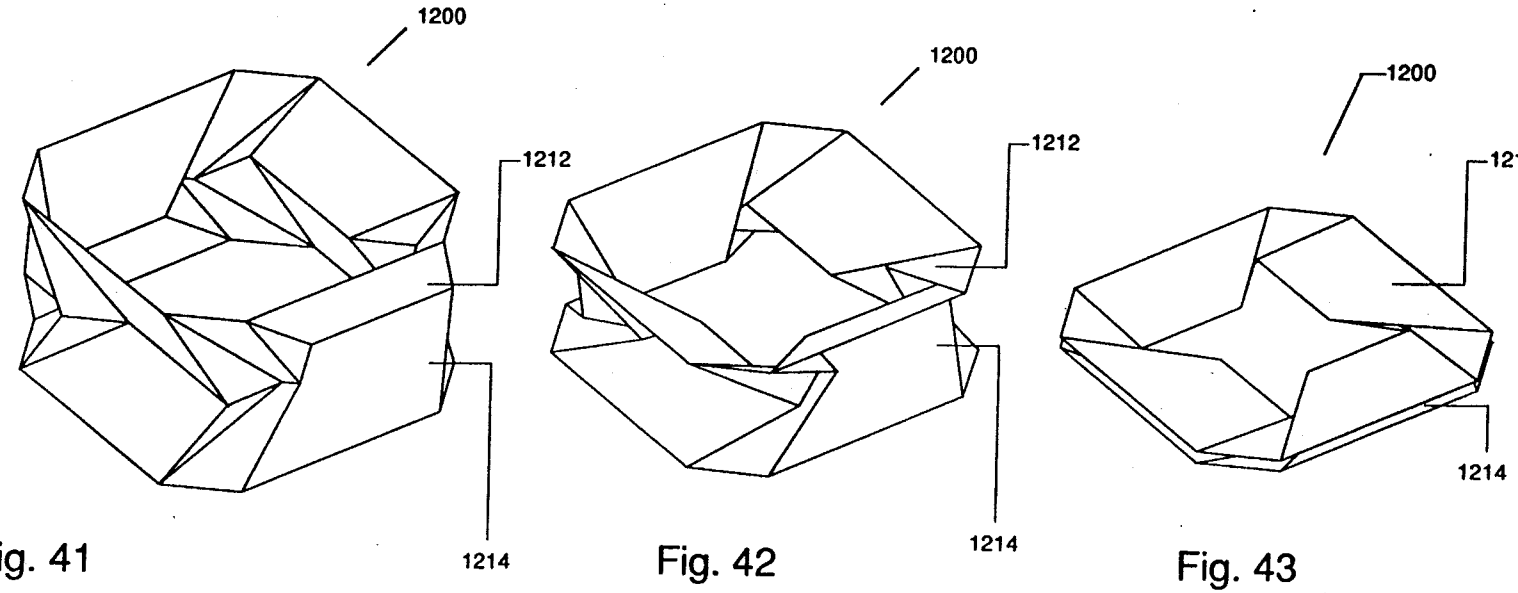
Fig. 41
Fig. 42
Fig. 43

CURVED PLEATED SHEET STRUCTURES

BACKGROUND OF THE INVENTION

The present invention relates to the provision of firm stable three-dimensional structures that can be made from a sheet of material. These structures are capable of being collapsed down to compact bundles.

There are many times when one wishes to have enclosures, containers or shelters that may be collapsed or flattened for ease of packaging or transportation.

Standard cardboard containers may be transported in a flattened state then folded to form a box, but this is a time-consuming process requiring gluing or insertion of tabs. The present invention provides structures that may be readily collapsed and expanded with simple motion. Once expanded they tend to 'pop' into position maintaining their shape.

When a standard cardboard container is flattened, its area or 'footprint' is larger than the erected box. Structures and enclosures made utilizing the present invention fold down to a size whose area is smaller than when they are opened.

A wide variety of shapes and forms may be constructed using this method underlying the present invention. Partially enclosed surfaces (i.e. tubular) or completely enclosed surfaces (i.e. the topological equivalent of a sphere) may be provided. Such enclosures can fold down to a flattened shape where the enclosing surface may maintain its integrity. Secondary flaps or seams are not required, but are permissible.

Many of the forms and shapes that can be made may be constructed from a single flat sheet of material that is scored or pleated. Because only a single flat sheet is required, many low cost manufacturing techniques may be employed, such as stamping, simple molds, etc.

REFERENCES TO PRIOR ART: MIURA-FOLDING

Miura et. al. [2D-Array Mission, American Institute of Aeronautics and Astronautics] disclose a doubly-corrugated folding pattern sometimes referred to as Miura folding.

Miura folding is a pleating pattern made into a sheet of material, that consists essentially of a matrix of identical parallelograms. As the sheet is folded it develops a doubly-corrugated surface, but maintains an essentially planar configuration.

My invention dispenses with the parallelism of the Miura system, so that triangles, trapeziums and trapezoids are provided, rather than parallelograms. What might be reasonably expected from this change is that the capability of the surface to develop (i.e. to fold smoothly) would be prevented.

Instead, the non-obvious result is that unlike the planar surface of Miura folding, surfaces of single and double curvature are formed. These surfaces can smoothly fold down to a flattened and compact state. The shapes and forms produced by this new folding pattern have usefulness as collapsible shelters, containers, etc.

A second surprising aspect of this discovery is that under many circumstances, the different edges of the folded sheet may be attached together, providing closed forms (i.e. tubes of cylindrical, conical or square shape). What is unexpected and non-obvious is that these shapes will still fold easily.

Further, under many circumstances a sheet of material may be continuously joined to an edge of these closed tubular forms thereby forming a completely enclosed shape useful as a container or box. Again, what is unexpected and non-obvious is that such forms will still fold easily.

Thus, while there is a similarity in the action of how Miura-folding takes place when compared to this invention, there are a number of significant differences. These differences are: the folding pattern itself; the shapes that derive from these patterns; the special connectivities and closures that may be made, still allowing the form to easily fold.

Significant differences between Miura-folding and the present invention

| Characteristic | Miura-folding | Present Invention |
|---|---|---|
| shape of facets | exclusively parallelograms | includes non-parallel shapes (triangles, trapeziums, trapezoids) |
| overall surface shape | 2-dimensional (planar) | 3-dimensional (singly curved or doubly-curved) |
| capability to join surface edges together | never possible | often possible (thereby providing tubes and boxes) |

REFERENCES TO PRIOR ART: LEATHER CHANGE-PURSE

Currently on the market, is a leather change-purse that has some minor points of similarity to the present invention.

It consists of a strip of leather forming the sides of a box, which is joined to a square that forms the base of the box. The strip is pleated to form a series of eight 45 degree right-angled triangles that are joined end-to-end to form a loop.

By making a twisting motion, the sides of the box may be flattened down to provide an enclosure for coins. Unlike the present invention which allows for structures made of reasonably stiff materials, the folding process for this change-purse requires a very significant flexing of the leather.

Another major point of difference between this purse and the present invention, is that the basic unit is a single strip, rather than two strips joined together. This completely avoids one of the essential aspects of the present invention, where a two-dimensional matrix of facets is folded, rather than a single one dimensional strip.

Further, if one takes this strip and joins it to another similar strip (that is a mirror image of the first one) in order to form a matrix of facets, it may be clearly demonstrated that such a structure/surface is incapable of folding.

So, not only does this purse not reveal a matrix of facets, but even were one to form such a matrix using its pleat-pattern as a model, it would not fold.

These significant differences lie at the heart of what is novel and non-obvious about the present invention. The present invention reveals how a two-dimensional matrix pattern of non-parallel pleats made on a sheet of material may smoothly develop and fold, thereby forming various useful shapes and forms.

BRIEF DESCRIPTION OF THE DRAWING FIGURES

The invention will be further described with reference to the accompanying drawings, wherein:

FIG. 36 is a plan view of a structure that is another embodiment of the invention.

FIGS. 37–39 are perspective views of the structure (shown in FIG. 36), which has a open box-like form, as it is folded down to its completely collapsed state.

FIG. 40 is a plan view of a unit that is another embodiment of the invention.

FIGS. 41–43 are perspective views of the unit (shown in FIG. 40), which has a open box-like form, as it is folded down to its completely collapsed state.

DETAILED DESCRIPTION

Figure 1:
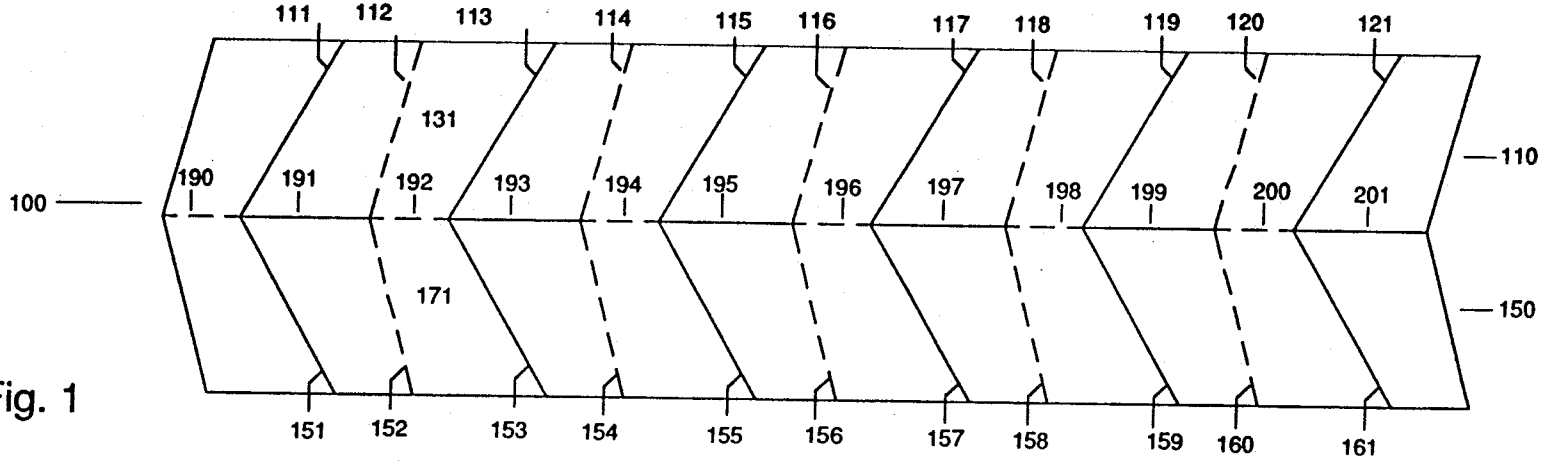
FIG. 1 is a plan view showing the basic unit of the invention having trapezium-shaped facets.

Referring now more particularly to the drawings, in FIG. 1 there is shown a unit 100, shown in a flat and unfolded state. Unit 100 is comprised of two strips 110 and 150. Strip 110 is pleated along a series of crossing lines 111–121 that cross it widthwise. The fold directions of adjacent crossing lines alternate. Crossing line 112 is non-parallel to crossing line 113 thereby forming a trapezium-shaped facet 131 between them. In a similar fashion, each successive cross line forms a finite angle with the crossing line adjacent to it, thereby forming a series of trapezium-shaped facets.

Similarly, strip 150 is pleated along a series of crossing lines 151–161 that cross it widthwise. The fold directions of adjacent crossing lines alternate. Crossing line 152 is non-parallel to crossing line 153 thereby forming a trapezium-shaped facet 171 between them. In a similar fashion, each successive cross line forms a finite angle with the crossing line adjacent to it, thereby forming a series of trapezium-shaped facets.

Crossing line 151 is essentially a continuation of crossing line 111. Similarly crossing lines 152–161 are essentially continuations of crossing lines 112–121 respectively.

Strip 110 is connected to strip 150 along a series of connecting pleat lines 190–201 which are connected end-to-end. The fold directions of connecting lines 190–201 alternate.

Figure 2:
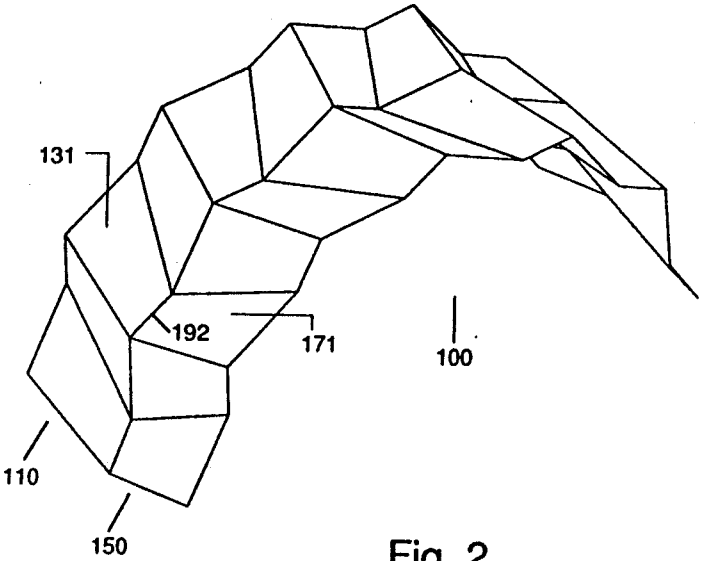
FIGS. 2–4 are perspective views of the unit as it is folded down to its completely collapsed state.

In FIG. 2 the unit 100 is shown partially folded. Strips 110 and 150 fold in a zig-zag fashion, remaining joined to one another by connecting lines 190–201. The surface formed by partially folded unit 100 has a curvature that runs lengthwise along the strips 110 and 150. Trapezium-shaped facets 131 and 171 joined by connecting line 192 form a finite dihedral angle between them. Similarly, the series of trapezium-shaped facets comprising strip 110 form dihedral angles with their respective adjacent facets in strip 150.

Figure 3:
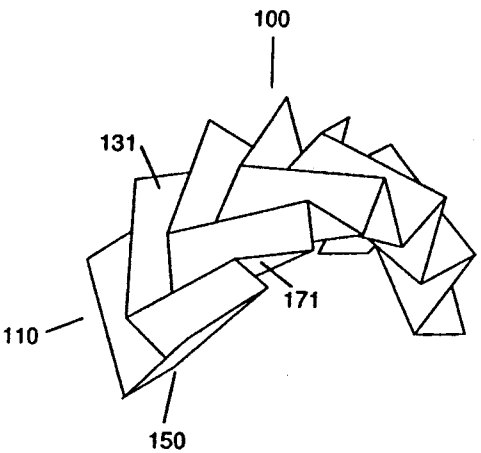

In FIG. 3 the unit 100 is shown folded to a further degree than FIG. 2. Facet 131 may seen to fold towards facet 171 thereby decreasing the dihedral angle between them. Note that the overall curvature of unit 100, as shown in FIG. 3, is essentially the same as its curvature when folded to a lesser degree, as shown in FIG. 2.

Figure 4:
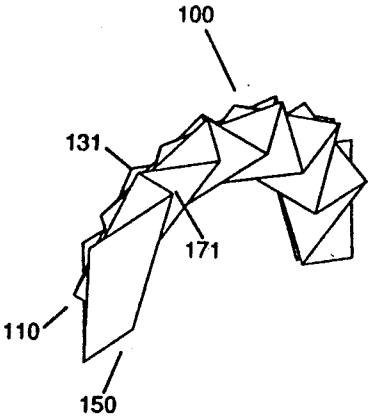

In FIG. 4 unit 100 is shown in an essentially fully folded configuration. Facet 131 is essentially stacked directly over facet 171. Similarly, each trapezium-shaped facet in strip 110 is essentially stacked directly over its respective adjacent facet in strip 150. Note that the overall curvature of unit 100, as shown in FIG. 4, remains essentially the same as its curvature when folded to a lesser degree, as shown in FIG. 2 and FIG. 3.

Figure 5:
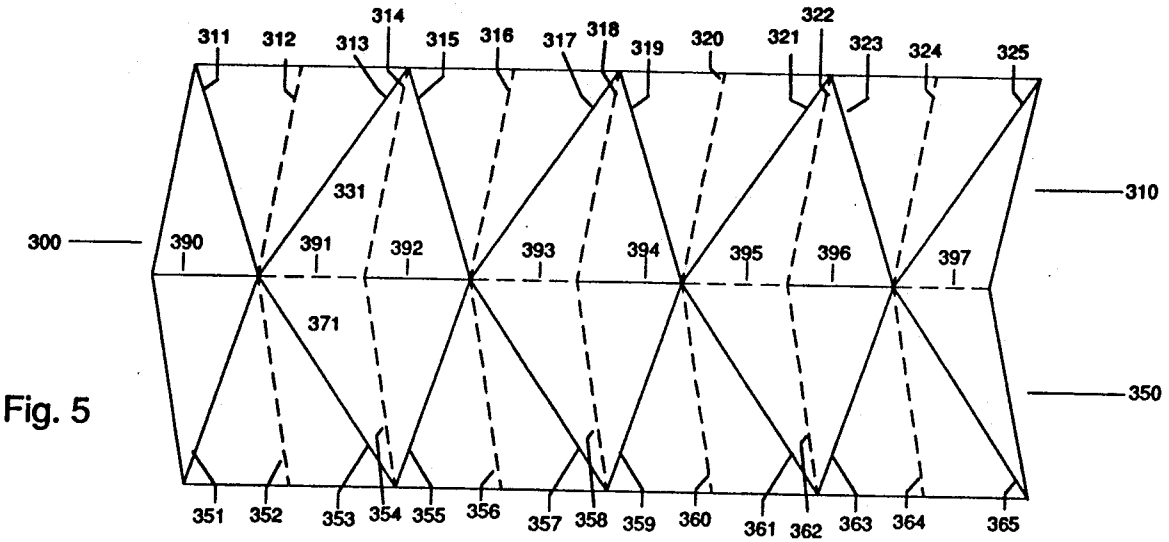
FIG. 5 is a plan view of an alternate embodiment of the invention having triangle-shaped facets.

In FIG. 5 there is shown a unit 300 which is an alternate embodiment of the invention. Unit 300 is shown in a flat and unfolded state. It is comprised of two strips 310 and 350. Strip 310 is pleated along a series of crossing lines 311–325 that cross it widthwise. The fold directions of adjacent crossing lines alternate. Crossing line 313 is non-parallel to crossing line 314 thereby forming a triangle-shaped facet 331 between them. In a similar fashion, each successive cross line forms a finite angle with the crossing line adjacent to it, thereby forming a series of triangle-shaped facets.

Similarly, strip 350 is pleated along a series of crossing lines 351–365 that cross it widthwise. The fold directions of adjacent crossing lines alternate. Crossing line 353 is non-parallel to crossing line 354 thereby forming a triangle-shaped facet 371 between them. In a similar fashion, each successive cross line forms a finite angle with the crossing line adjacent to it, thereby forming a series of triangle-shaped facets.

Strip 310 is connected to strip 350 along a series of connecting pleat lines 390–397 which are connected end-to-end. The fold directions of connecting lines 390–397 alternate.

Figure 6:
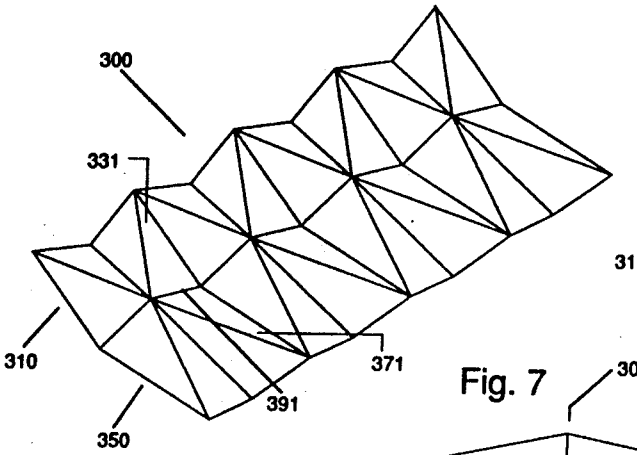
FIG. 6 is a perspective views of the unit shown in FIG. 5 in a partially folded state.

In FIG. 6 the unit 300 is shown partially folded. Strips 310 and 350 fold in a zig-zag fashion, remaining joined to one another by connecting lines 390–397. Triangle-shaped facets 331 and 371 joined by connecting line 391 form a finite dihedral angle between them. Similarly, the series of triangle-shaped facets comprising strip 310 form finite dihedral angles with their respective adjacent facets in strip 350.

Figure 7:
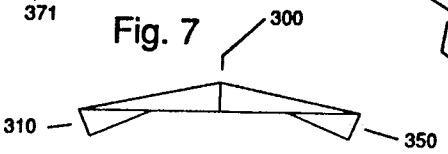
FIG. 7 is an end view of the partially folded unit shown in FIG. 6.

In FIG. 7 the unit 300 is shown viewed from its end. It may be clearly seen that the surface formed by partially folded unit 300 has a curvature that runs crosswise from the length of strips 310 and 350.

Figure 8:
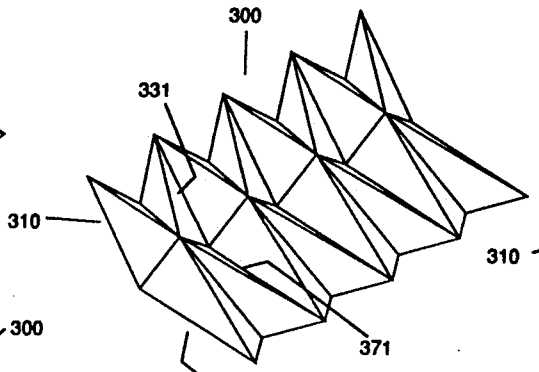
FIGS. 8–9 are perspective views of the unit shown in FIG. 5 as it is folded down to its completely collapsed state.

In FIG. 8 the unit 300 is shown folded to a further degree than FIG. 7. Facet 331 may seen to fold towards facet 371 thereby decreasing the dihedral angle between them.

Figure 9:
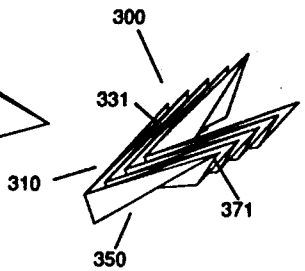

In FIG. 9 unit 100 is shown in an essentially fully folded configuration. Facet 331 is essentially stacked directly over facet 371. Similarly, each triangle-shaped facet in strip 310 is essentially stacked directly over its respective adjacent facet in strip 350.

Figure 10:
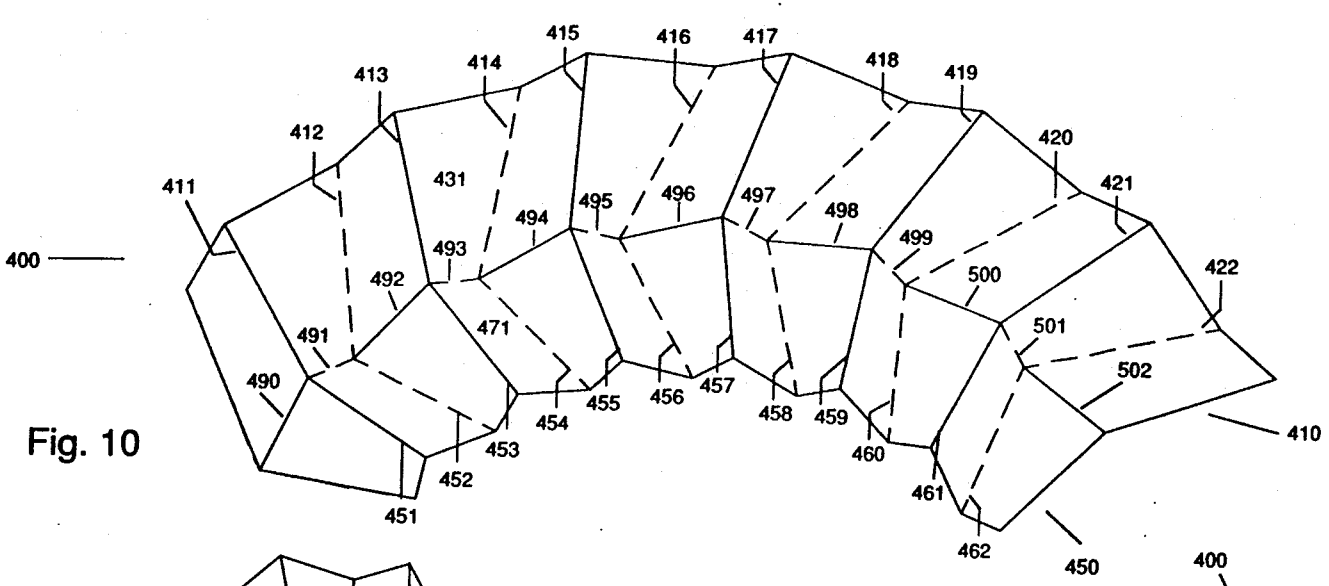
FIG. 10 is a plan view of an alternate embodiment of the invention having trapezoid-shaped facets.

In FIG. 10 there is shown a unit 400 which is an alternate embodiment of the invention. Unit 400 is shown in a flat and unfolded state. It is comprised of two strips 410 and 450. Strip 410 is pleated along a series of crossing lines 411–422 that cross it widthwise. The fold directions of adjacent crossing lines alternate. Crossing line 413 is non-parallel to crossing line 414 thereby forming a trapezoid-shaped facet 431 between them. In a similar fashion, each successive cross line forms a finite angle with the crossing line adjacent to it, thereby forming a series of trapezoid-shaped facets.

Similarly, strip 450 is pleated along a series of crossing lines 451–462 that cross it widthwise. The fold directions of adjacent crossing lines alternate. Crossing line 453 is non-parallel to crossing line 454 thereby forming a trapezoid-shaped facet 471 between them. In a similar fashion, each successive cross line forms a finite angle with the crossing line adjacent to it, thereby forming a series of trapezoid-shaped facets.

Crossing line 451 is essentially a continuation of crossing line 411. Similarly crossing lines 452–462 are essentially continuations of crossing lines 412–422 respectively.

Strip 410 is connected to strip 450 along a series of connecting pleat lines 490–502 which are connected end-to-end. The fold directions of connecting lines 490–502 alternate.

Figure 11:
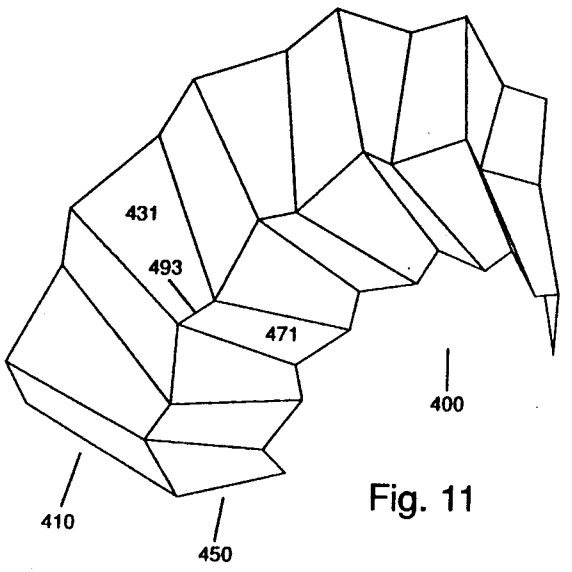
FIGS. 11–13 are perspective views of the unit shown in FIG. 10 as it is folded down to its completely collapsed state.

In FIG. 11 the unit 400 is shown partially folded. Strips 410 and 450 fold in a zig-zag fashion, remaining joined to one another by connecting lines 490–502. The surface formed by partially folded unit 400 is essentially conical, and has a curvature that runs lengthwise along the strips 410 and 450. Trapezoid-shaped facets 431 and 471 joined by connecting line 493 form a finite dihedral angle between them. Similarly, the series of trapezoid-shaped facets comprising strip 410 form dihedral angles with their respective adjacent facets in strip 450.

Figure 12:
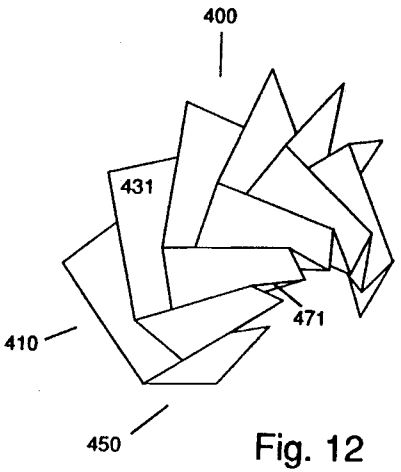

In FIG. 12 the unit 400 is shown folded to a further degree than FIG. 11. Facet 431 may seen to fold towards facet 471 thereby decreasing the dihedral angle between them. Note that the overall curvature of unit 400, as shown in FIG. 12, is essentially the same as its curvature when folded to a lesser degree, as shown in FIG. 11.

Figure 13:
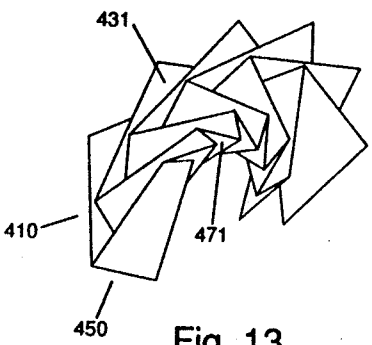

In FIG. 13 unit 400 is shown in an essentially fully folded configuration. Facet 431 is essentially stacked directly over facet 471. Similarly, each trapezoid-shaped facet in strip 410 is essentially stacked directly over its respective adjacent facet in strip 450. Note that the overall curvature of unit 400, as shown in FIG. 13, remains essentially the same as its curvature when folded to a lesser degree, as shown in FIG. 11 and FIG. 12.

Figure 14:
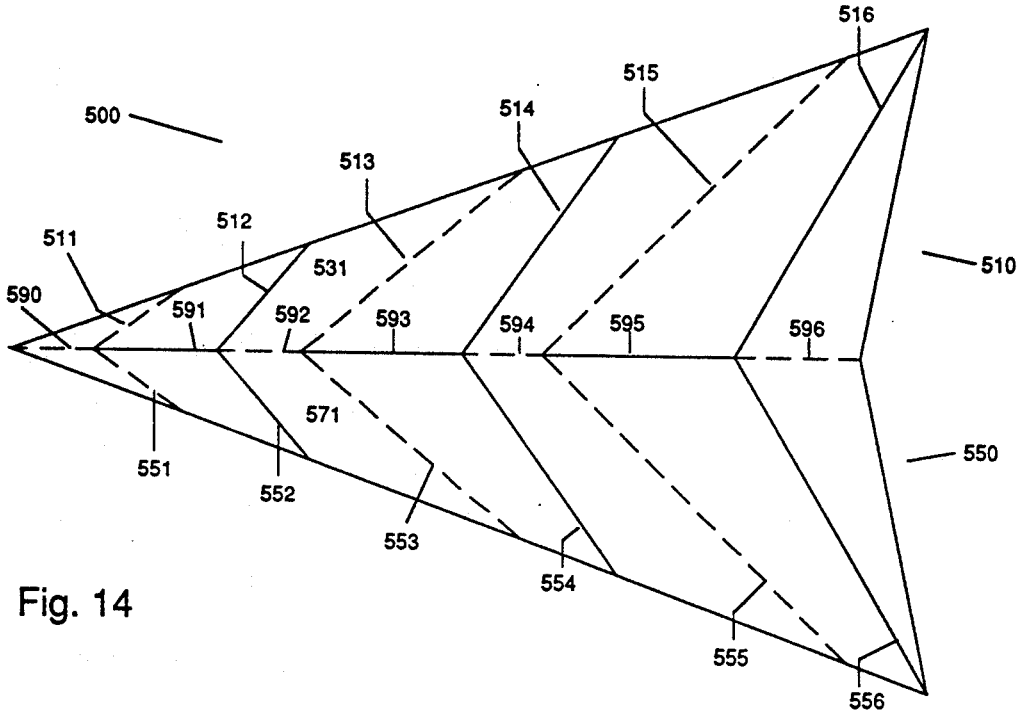
FIG. 14 is a plan view of an alternate embodiment of the invention having trapezoid-shaped facets.

In FIG. 14 there is shown a unit 500 which is an alternate embodiment of the invention. Unit 500 is shown in a flat and unfolded state. It is comprised of two strips 510 and 550. Strip 510 is pleated along a series of crossing lines 511–516 that cross it widthwise. The fold directions of adjacent crossing lines alternate. Crossing line 512 is non-parallel to crossing line 513 thereby forming a trapezoid-shaped facet 531 between them. In a similar fashion, each successive cross line forms a finite angle with the crossing line adjacent to it, thereby forming a series of trapezoid-shaped facets.

Similarly, strip 550 is pleated along a series of crossing lines 551–556 that cross it widthwise. The fold directions of adjacent crossing lines alternate. Crossing line 552 is non-parallel to crossing line 553 thereby forming a trapezoid-shaped facet 571 between them. In a similar fashion, each successive cross line forms a finite angle with the crossing line adjacent to it, thereby forming a series of trapezoid-shaped facets.

Crossing line 551 is essentially a continuation of crossing line 511. Similarly crossing lines 552–556 are essentially continuations of crossing lines 512–516 respectively.

Strip 510 is connected to strip 550 along a series of connecting pleat lines 590–596 which are connected end-to-end. The fold directions of connecting lines 590–596 alternate.

Figure 15:
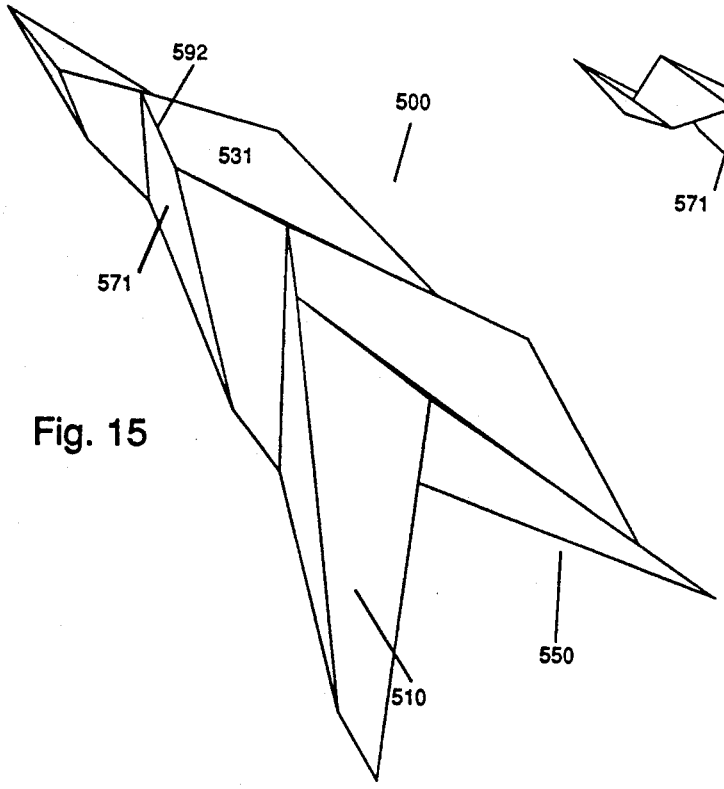
FIGS. 15–16 are perspective views of the unit shown in FIG. 14 as it is folded down to its completely collapsed state.

In FIG. 15 the unit 500 is shown partially folded. Strips 510 and 550 fold in a zig-zag fashion, remaining joined to one another by connecting lines 590–596. The surface formed by partially folded unit 500 has a curvature that runs lengthwise and crosswise along the strips 510 and 550. Trapezoid-shaped facets 531 and 571 joined by connecting line 592 form a finite dehedral angle between them. Similarly, the series of trapezoidshaped facets comprising strip 510 form dihedral angles with their respective adjacent facets in strip 550.

Figure 16:
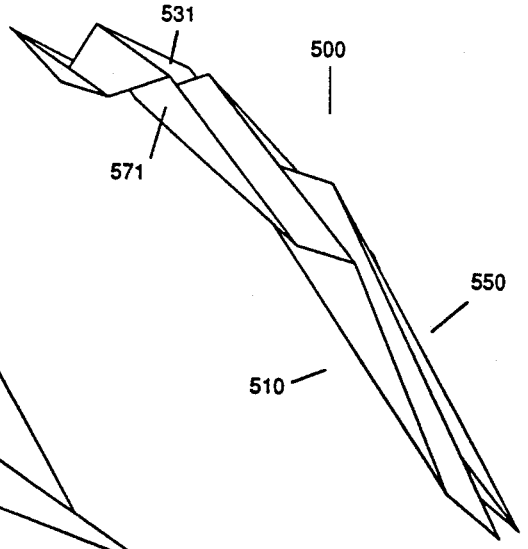

In FIG. 16 unit 500 is shown in an essentially fully folded configuration. Facet 531 is essentially stacked directly over facet 571. Similarly, each trapezoid-shaped facet in strip 510 is essentially stacked directly over its respective adjacent facet in strip 550.

Figure 17:
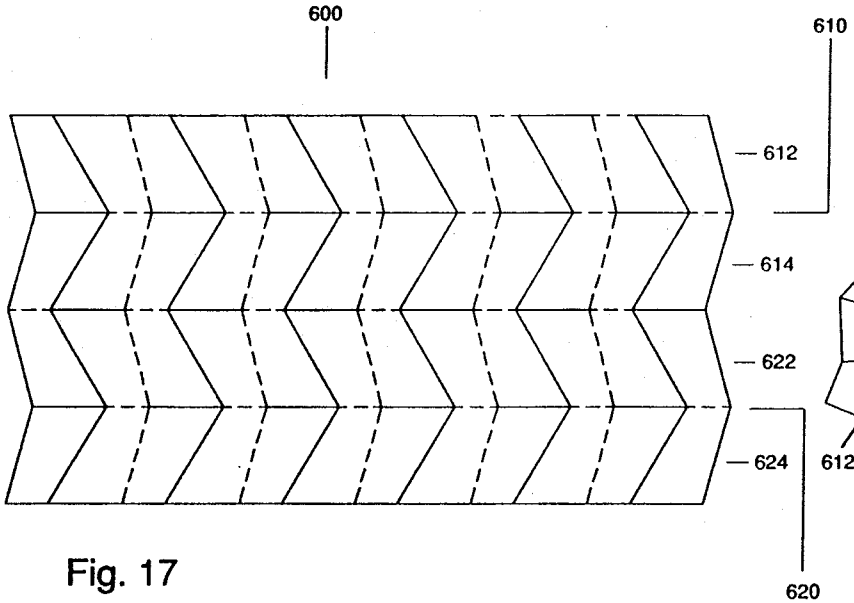
FIG. 17 is a plan view of a structure that is a further embodiment of the invention.

In FIG. 17 structure 600 is comprised of units 610 and 620 (which are similar to unit 100 shown in FIGS. 1–4). Structure 600 is shown in a flat and unfolded configuration. Unit 610 is made up of strips 612 and 614. Similarly unit 620 is made up of strips 622 and 624. Unit 610 is connected to adjacent unit 620 by a series of connecting pleat lines that are connected end-to-end.

Figure 18:
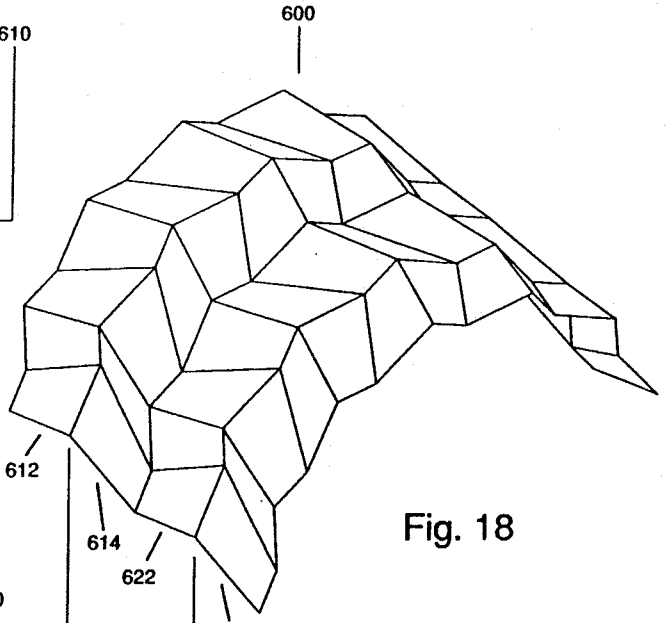
FIGS. 18–20 are perspective views of the structure (shown in FIG. 17), which has a singly curved surface, as it is folded down to its completely collapsed state.

In FIG. 18 the structure 600 is shown in partially folded. The surface formed has a curvature running along the lengths of the units 610 and 620.

Figure 19:
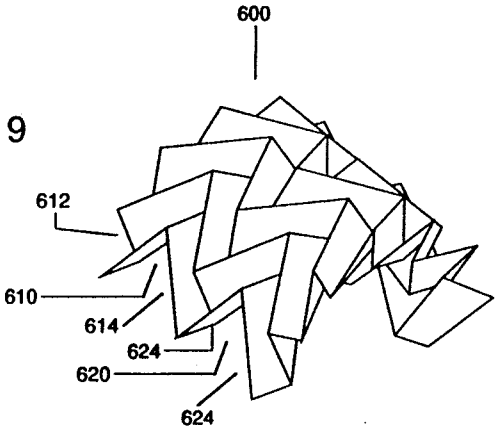

In FIG. 19 the structure 600 is shown folded to a further degree than in FIG. 18. The strips 612, 614, 622 and 624 may be seen to fold towards each other. The overall curvature of unit 600, as shown in FIG. 19, is essentially the same as its curvature when folded to a lesser degree, as shown in FIG. 18.

Figure 20:
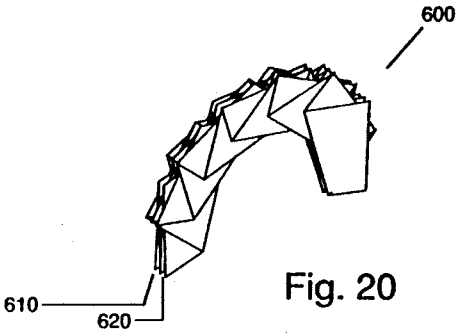

In FIG. 20 the structure 600 is shown in fully folded configuration. Units 610 and 620 are essentially stacked one over the other. The overall curvature of unit 600, as shown in FIG. 19, remains essentially the same as its curvature when folded to a lesser degree, as shown in FIG. 18 and FIG. 19.

In order to cause structure 600 to transform from its partially folded state, as shown in FIG. 18, to its fully folded state, shown in FIG. 20, all that is required is that the two outer lengthwise edges of units 610 and 620 be pushed together with a simple straight-line motion.

Figure 21:
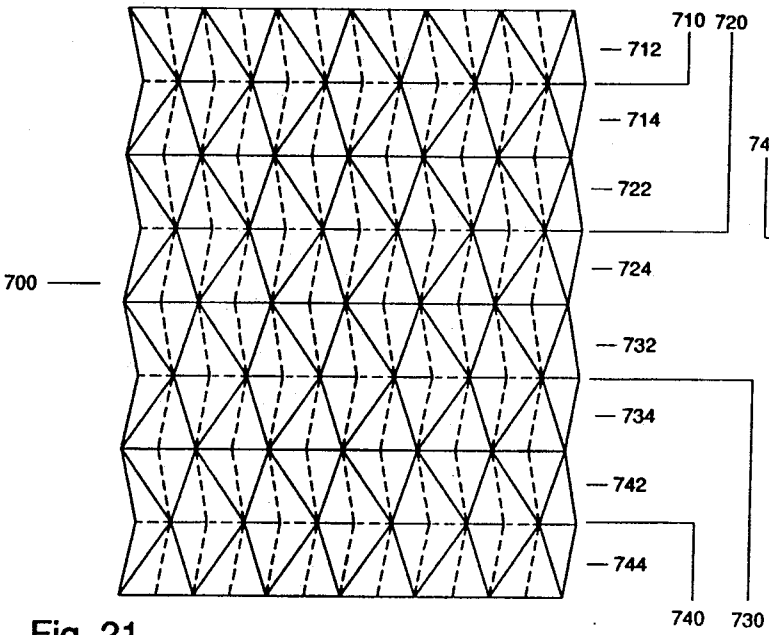
FIG. 21 is a plan view of a structure that is another embodiment of the invention.

In FIG. 21 structure 700 is comprised of units 710, 720, 730 and 740 (which are similar to unit 300 shown in FIGS. 5–9). Unit 710 is made up of strips 712 and 714. Similarly units 720, 730 and 740 are made up of strips 722, 724 and 732, 734 and 742, 744 respectively. Unit 710 is joined to adjacent unit 720 by a series of connecting pleat lines that are joined end-to-end. Similarly units 720, 730 and 740 are joined to their respective adjacent units by connecting pleat lines.

Figure 22:
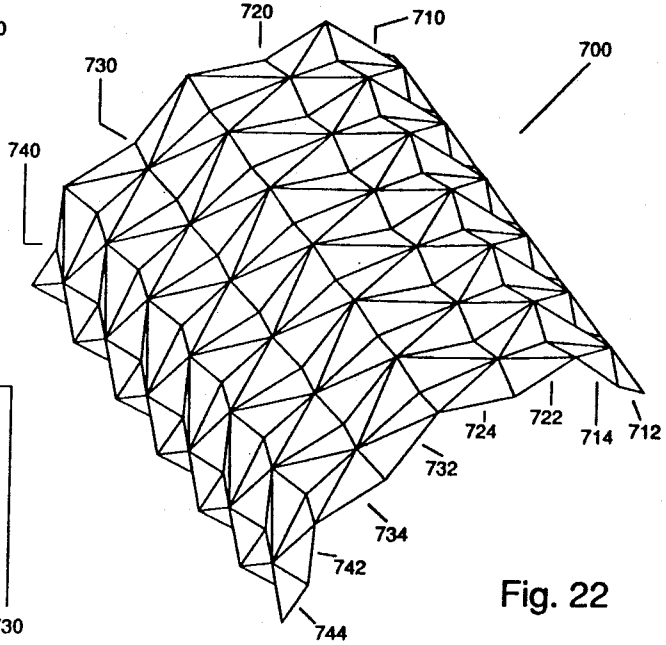
FIGS. 22–24 are perspective views of the structure (shown in FIG. 21), which has a singly curved surface, as it is folded down to its completely collapsed state.

In FIG. 22 the structure 700 is shown partially folded. The surface formed has a curvature running crosswise from the lengths of the strips 712, 714, 722, 724, 732, 734, 742 and 744.

Figure 23:
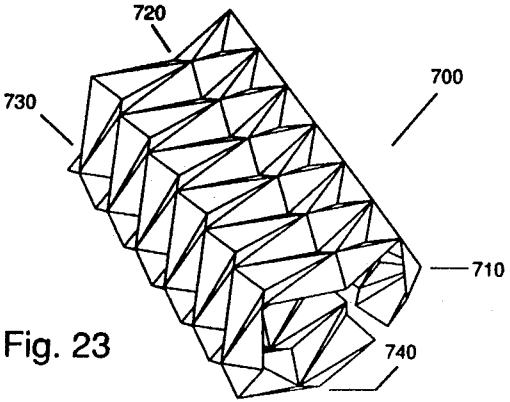

In FIG. 23 the stucture 700 is shown folded to a further degree than in FIG. 22. The strips 712,714,722,724,732,734,742 and 744 may be seen to fold towards each other.

Figure 24:
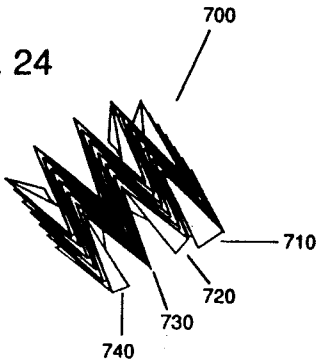

In FIG. 24 the structure 700 is shown in fully folded configuration. Strips strips 712,714,722,724,732,734,742 and 744 are essentially stacked one over the other.

Figure 25:
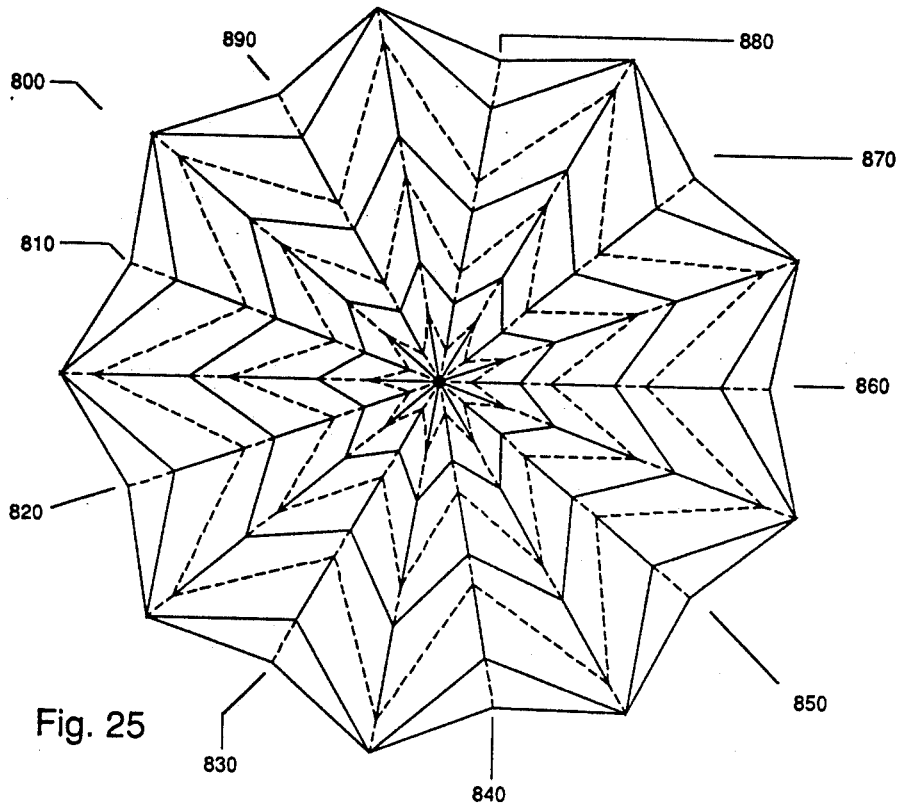
FIG. 25 is a plan view of a structure that is another embodiment of the invention.

In FIG. 25 structure 800 is comprised of units 810,820,830,840,850,860,870,880 and 890 (which are similar to unit 500 shown in FIGS. 14–16). Unit 810 is joined to adjacent unit 820 by a series of connecting pleat lines that are joined end-to-end. Similarly units 820,830,840,850,860,870,880 and 890 are joined to their respective adjacent units by connecting pleat lines.

Figure 26:
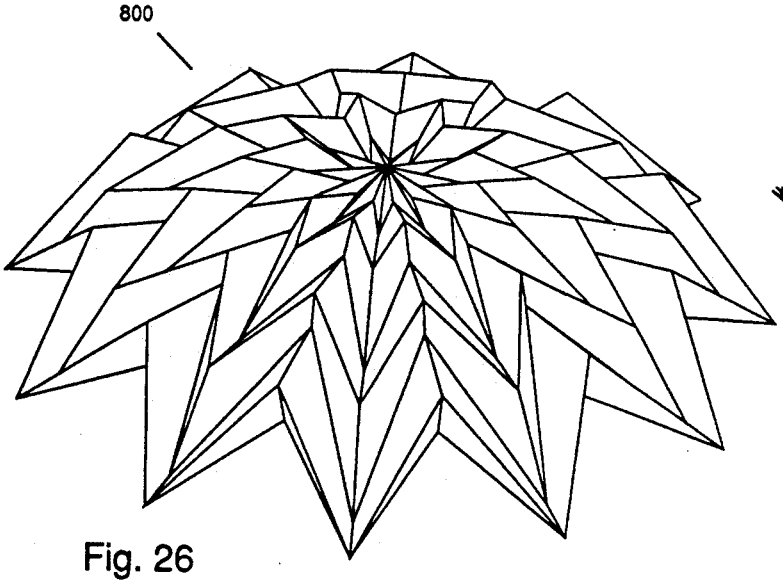
FIGS. 26–27 are perspective views of the structure (shown in FIG. 25), which has a doubly curved surface, as it is folded down to its completely collapsed state.

In FIG. 26 the structure 800 is shown partially folded. The surface formed has a curvature running crosswise and lengthwise along the lengths of the units 810,820,830,840,850,860,870,880 and 890.

Figure 27:
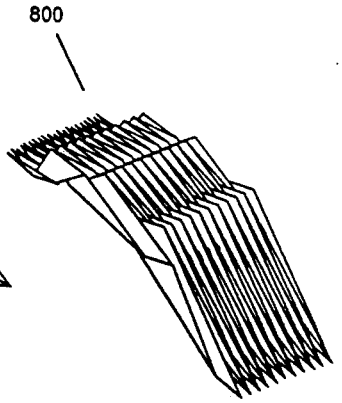

In FIG. 27 the structure 800 is shown in fully folded configuration. Units 810,820,830,840,850,860,870,880 and 890 are essentially stacked one over the other.

Figure 28:
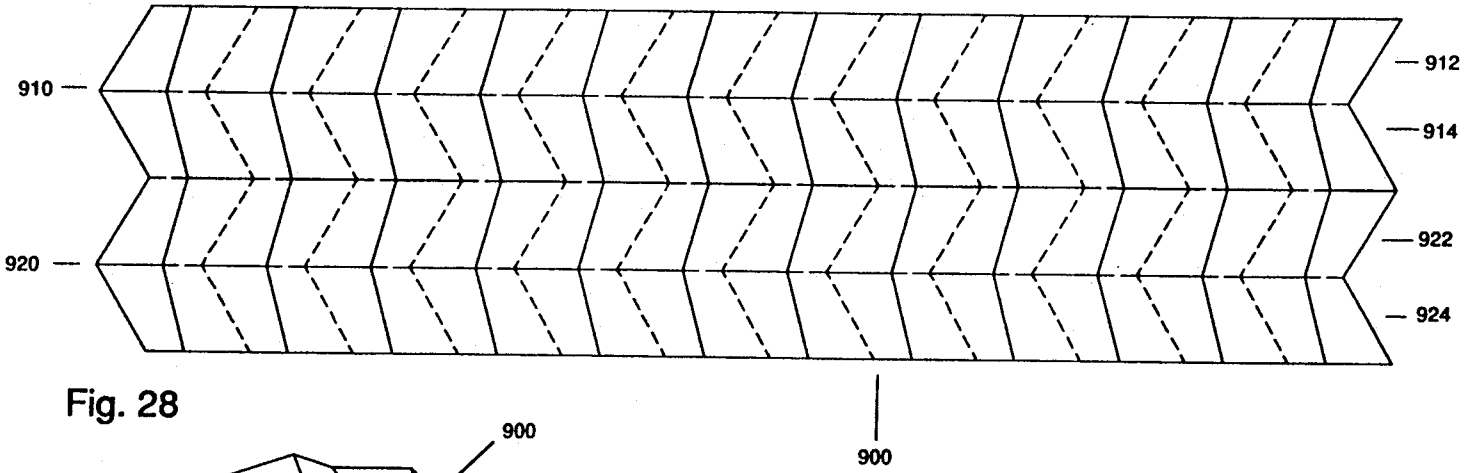
FIG. 28 is a plan view of a structure that is another embodiment of the invention.

In FIG. 28 structure 900 is comprised of units 910 and 920. Unit 910 is made up of strips 912 and 914 each of which consist of a series of trapezium-shaped facets. Similarly unit 920 is made up of strips 922 and 924. Unit 910 is connected to adjacent unit 920 by a series of connecting pleat lines that are connected end-to-end.

Figure 29:
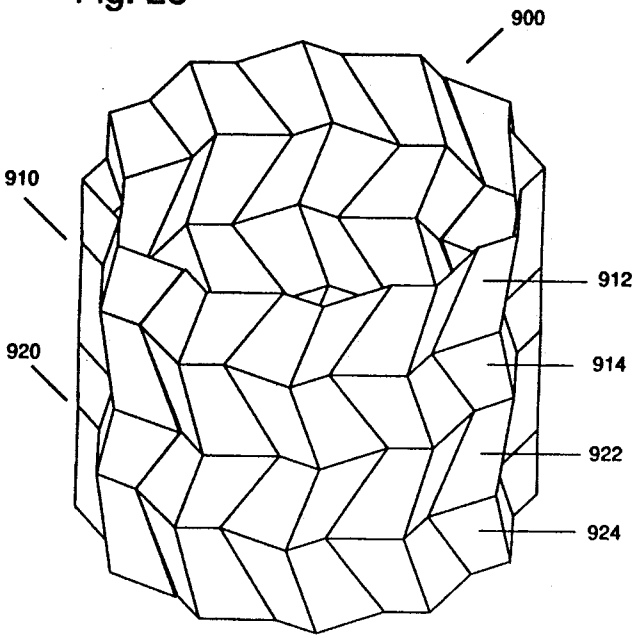
FIGS. 29–31 are perspective views of the structure (shown in FIG. 28), which has a tubular form, as it is folded down to its completely collapsed state.

In FIG. 29 the structure 900 is shown in a partially folded state, its form being essentially a cylindrical tube. The surface formed has a curvature running along the lengths of the units 910 and 920. The two ends of unit 910 have been joined one to the other, thereby forming a loop. Likewise, the two ends of unit 920 have been joined one to the other, thereby forming a loop.

Figure 30:
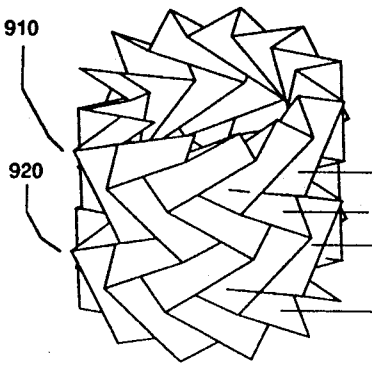

In FIG. 30 the stucture 900 is shown folded to a further degree than in FIG. 18, its form remaining essentially cylindrical. The strips 912,914,922 and 924 may be seen to fold towards each other. The two ends of units 910 remain joined together as do the two ends of unit 920.

Figure 31:
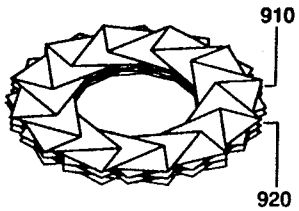

In FIG. 31 the structure 900 is shown in fully folded configuration, taking the form of a flattened ring. Units 910 and 920 are essentially stacked one over the other. The ends of units 910 and 920 remain joined together. The overall curvature of unit 900, as shown in FIG. 31, remains essentially the same as its curvature when folded to a lesser degree, as shown in FIG. 29 and FIG. 30.

In order to cause structure 900 to transform from its partially folded state, as shown in FIG. 29, to its fully folded state, shown in FIG. 31, all that is required is that the ends of the cylinder be pushed together with a simple straight-line motion.

Figure 32:
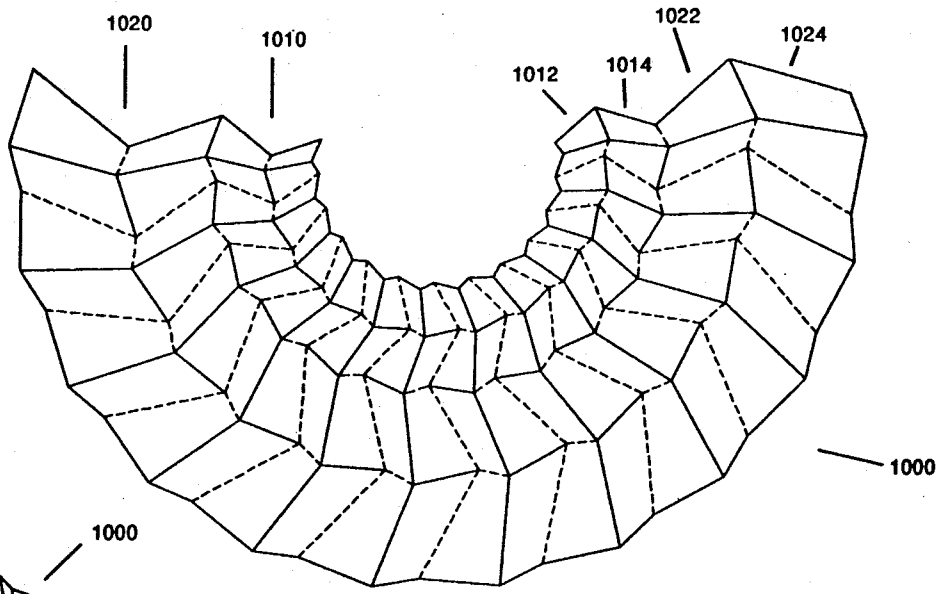
FIG. 32 is a plan view of a structure that is another embodiment of the invention.

In FIG. 32 structure 1000 is comprised of units 1010 and 1020. Unit 1010 is made up of strips 1012 and 1014 each of which consists of a series of trapezoid-shaped facets. Similarly unit 1020 is made up of strips 1022 and 1024 which also consist of trapezoidshaped facets. Unit 1010 is connected to adjacent unit 1020 by a series of connecting pleat lines that are connected end-to-end.

Figure 33:
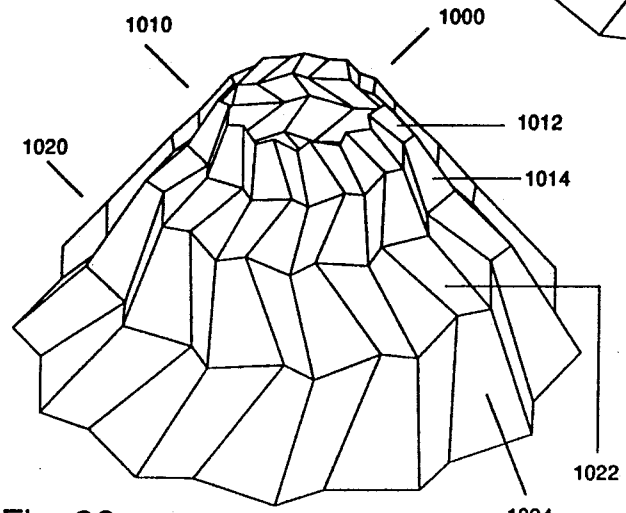
FIGS. 33–35 are perspective view of the structure (shown in FIG. 32), which has a conical form, as it is folded down to its completely collapsed state.

In FIG. 33 the structure 1000 is shown in a partially folded state, its form being essentially a cone. The surface formed has a curvature running along the lengths of the units 1010 and 1020. The two ends of unit 1010 have been joined one to the other, thereby forming a loop of conical aspect. Likewise, The two ends of unit 1020 have been joined one to the other, thereby forming a loop.

Figure 34:
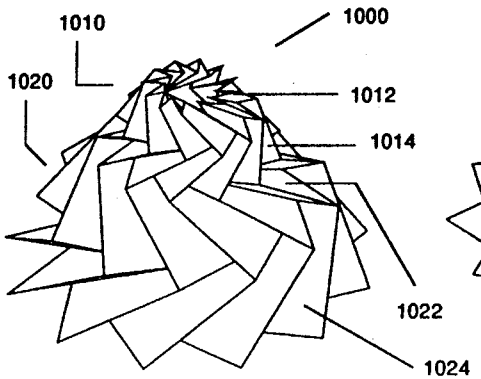

In FIG. 34 the stucture 1000 is shown folded to a further degree than in FIG. 18, its form remaining essentially conical. The strips 1012,1014,1022 and 1024 may be seen to fold towards each other. The two ends of units 1010 remain joined together as do the two ends of unit 1020.

Figure 35:
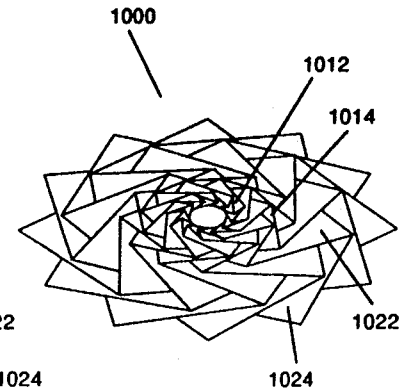

In FIG. 35 the structure 1000 is shown in fully folded configuration, taking the form of a flattened disc. Units 1010 and 1020 are essentially stacked one over the other. The ends of units 1010 and 1020 remain joined together.

In order to cause structure 1000 to transform from its partially folded state, as shown in FIG. 33, to its fully folded state, shown in FIG. 35, all that is required is that the base and peak of the conical structure 1000 be pushed together with a simple straight-line motion.

In FIG. 36 structure 1100 is comprised of units 1110 and 1120. Unit 1110 is made up of strips 1112 and 1114 each of which consists of a series of trapezium-shaped facets. Similarly unit 1120 is made up of strips 1122 and 1124. Unit 1110 is connected to adjacent unit 1120 by a series of connecting pleat lines that are connected end-to-end.

In FIG. 37 the structure 1100 is shown in a partially folded state, its form being essentially an open-ended box. The surface formed has a curvature running along the lengths of the units 1110 and 1120. The two ends of unit 1110 have been joined one to the other, thereby forming a loop. Likewise, The two ends of unit 1120 have been joined one to the other, thereby forming a loop.

In FIG. 38 the structure 1100 is shown folded to a further degree than in FIG. 18, its form remaining essentially box-like. The strips 1112, 1114, 1122 and 1124 may be seen to fold towards each other. The two ends of units 1110 remain joined together as do the two ends of unit 1120.

In FIG. 39 the structure 1100 is shown in fully folded configuration, taking the form of a flattened square. Units 1110 and 1120 are essentially stacked one over the other. The ends of units 1110 and 1120 remain joined together.

In order to cause structure 1100 to transform from its partially folded state, as shown in FIG. 37, to its fully folded state, shown in FIG. 39, all that is required is that the ends of the box be pushed together with a simple straight-line motion.

In FIG. 40 is shown unit 1200. Unit 1200 is made up of strips 1212 and 1214 each of which consists of a series of triangle-shaped and trapezium-shaped facets.

In FIG. 41 the unit 1200 is shown in a partially folded state, its form being essentially an open-ended box. The surface formed has a curvature running along the lengths of the units 1200. The two ends of unit 1200 have been joined one to the other, thereby forming a loop.

In FIG. 42 the unit 1200 is shown folded to a further degree than in FIG. 18, its form remaining essentially box-like. The strips 1212 and 1214 may be seen to fold towards each other. The two ends of units 1200 remain joined together.

In FIG. 43 the unit 1200 is shown in fully folded configuration, taking the form of a flattened square. The two ends of units 1200 remain joined together. In order to cause structure 1200 to transform from its partially folded state, as shown in FIG. 41, to its fully folded state, shown in FIG. 43, all that is required is that the ends of the box be pushed together with a simple straight-line motion.

Figures 44, 45, 46:
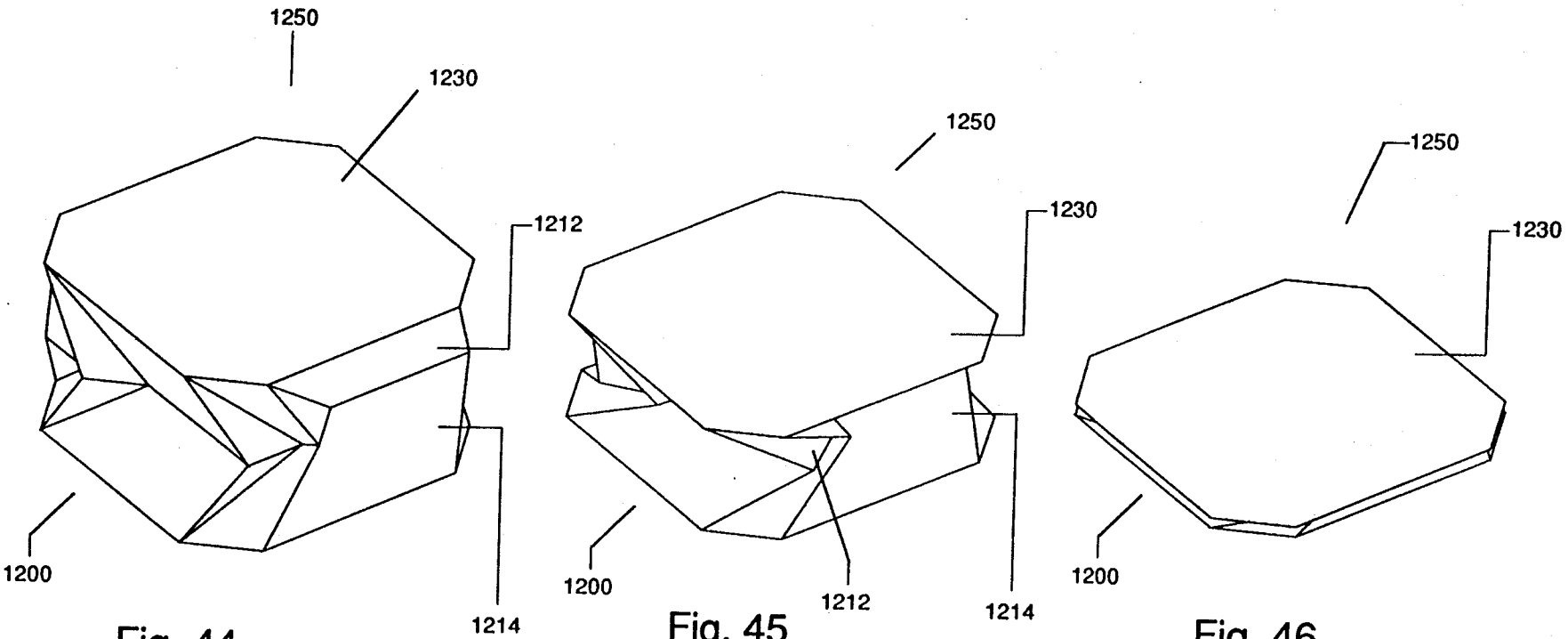
FIGS. 44–46 are perspective views of the unit (shown in FIGS. 40–43), with a top surface attached to provide a closed box, as it is folded down to its completely collapsed state.

In FIG. 44 the structure 1250 which is shown consists of the unit 1200 and a flat sheet 1230. Unit 1200 is shown in a partially folded state with the flat sheet 1230 joined continuously along the length of an edge of unit 1200. The sheet 1230 provides a cover for the box.

In FIG. 45 the structure 1250 is shown folded to a further degree than in FIG. 44, its form remaining essentially box-like. The strips 1212 and 1214 may be seen to fold towards each other. The two ends of units 1200 remain joined together. The sheet 1230 remains joined continuously along the edge of unit 1200.

In FIG. 46 the unit/structure 1200 is shown in fully folded configuration, taking the form of a flattened square. The sheet 1230 remains joined continuously along the edge of unit 1200. In order to cause structure 1200 to transform from its partially folded state, as shown in FIG. 44, to its fully folded state, shown in FIG. 46, all that is required is that the top and bottom of the box be pushed together with a simple straight-line motion.

Figure 47:
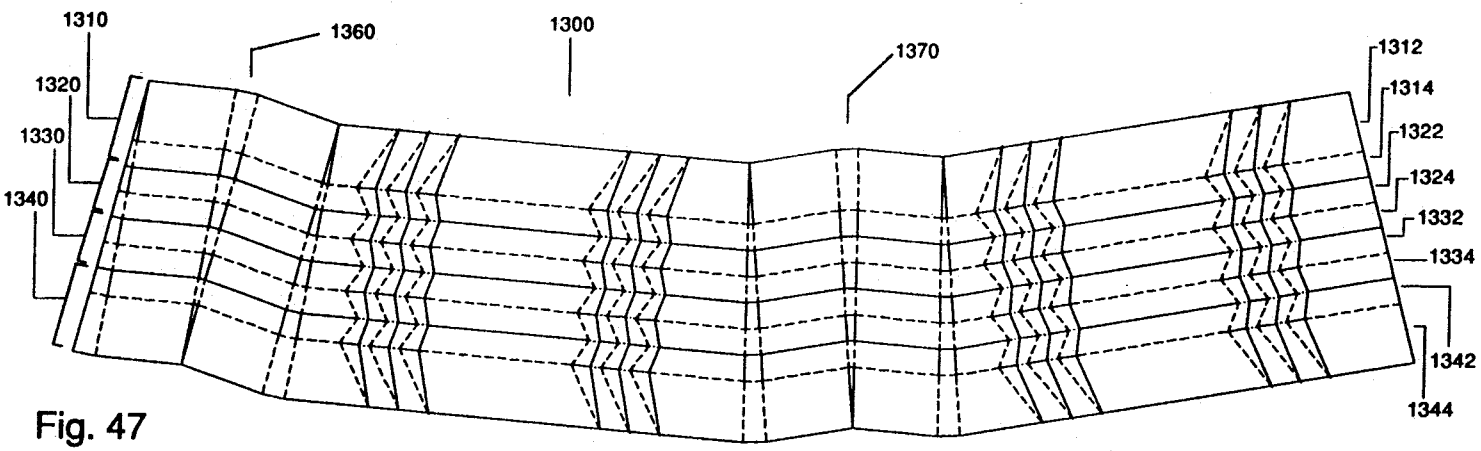
FIG. 47 is a plan view of a structure that is another embodiment of the invention.

FIG. 47 shows the structure 1300 in a flat and unfolded configuration. The structure 1300 consists of units 1310, 1320, 1330 and 1340. Unit 1310 is comprised by strips 1312 and 1314 which are in turn comprised by a series of facets consisting of triangles, trapeziums and parallelograms. Likewise unit 1330 consists of strips 1332 and 1334. Likewise, unit 1340 consists of strips 1342 and 1344. Within structure 1300 there are two regions 1360 and 1370 that reveal an alternate secondary pleating pattern.

Unit 1310 is joined to 1320 by a series of connecting pleat lines that are connected end-to-end. Likewise, unit 1320 is joined to 1330 which is in turn joined to unit 1340.

Figure 48:
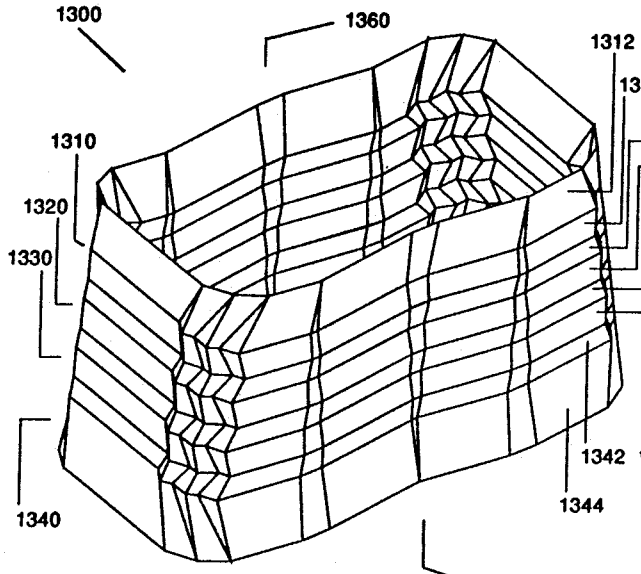

In FIG. 48 the structure 1300 is shown in a partially folded configuration, making the form of an open-ended box. The two ends of unit 1310 have been joined together, thereby forming a loop. Likewise the two ends of units 1320, 1330 and 1340 have been respectively joined together forming loops. Units 1310, 1320, 1330, and 1340 remain joined along their lengths by connecting pleat lines. Regions 1360 and 1370 may be seen to form an alternate secondary folding pattern along two of the sides of the box.

Figure 49:
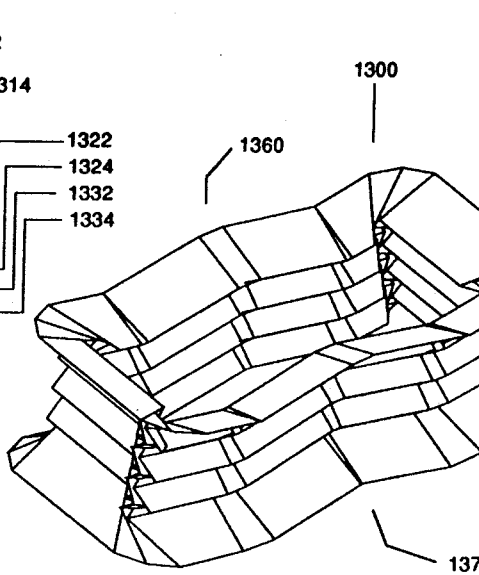
FIGS. 48–50 are perspective views of the structure (shown in FIG. 47), which has a open box-like form, as it is folded down to its completely collapsed state.

FIG. 49 shows the structure 1300 folded to a further degree than FIG. 48. The two ends of units 1310, 1320, 1330 and 1340 remain respectively joined together forming loops. The overall form of 1300 remains that of an open-ended box. Regions 1360 and 1370 continue to fold in an alternate folding pattern that introduces a secondary zig-zag corrugation along two sides of the box.

Figure 50:
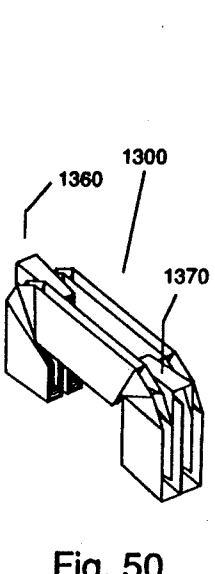

FIG. 50 shows the structure 1300 in an essentially fully folded configuration, which takes the form of a compact bundle. Units 1310, 1320, 1330 and 1340 have been essentially flattened against each other. In addition, due to the folding pattern of regions 1360 and 1370, units 1310, 1320, 1330 and 1340 may be seen to take on a zig-zag, nested form. The effect of fully folded regions 1360 and 1370, is to significantly reduce the size of the packaged structure 1300.

Figures 51, 52, 53:
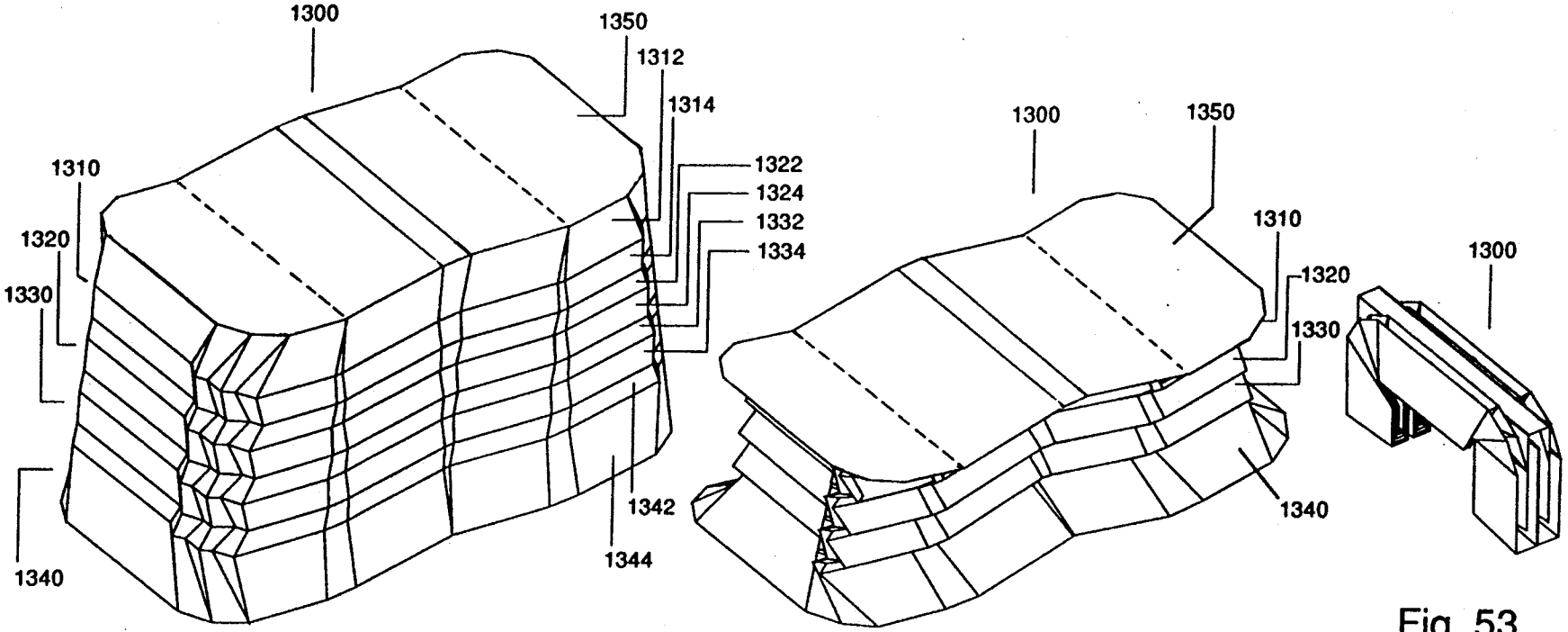
FIGS. 51–53 are perspective views of the structure (shown in FIGS. 47–50), with a top surface attached to provide a closed box, as it is folded down to its completely collapsed state.

In FIG. 51 the structure 1300 is shown in a partially folded configuration with the sheet 1350 joined to it. Specifically, sheet 1350 is joined continuously to unit 1310 along its edge, thereby providing a cover to the box.

FIG. 52 shows the structure 1300 folded to a further degree than FIG. 51. The sheet 1350 remains joined continuously to unit 1310, folding with the structure 1300.

FIG. 53 shows the fully folded structure 1300. The sheet 1350 remains joined continuously to unit 1310, nesting within the fully folded structure 1300.

Figure 54:
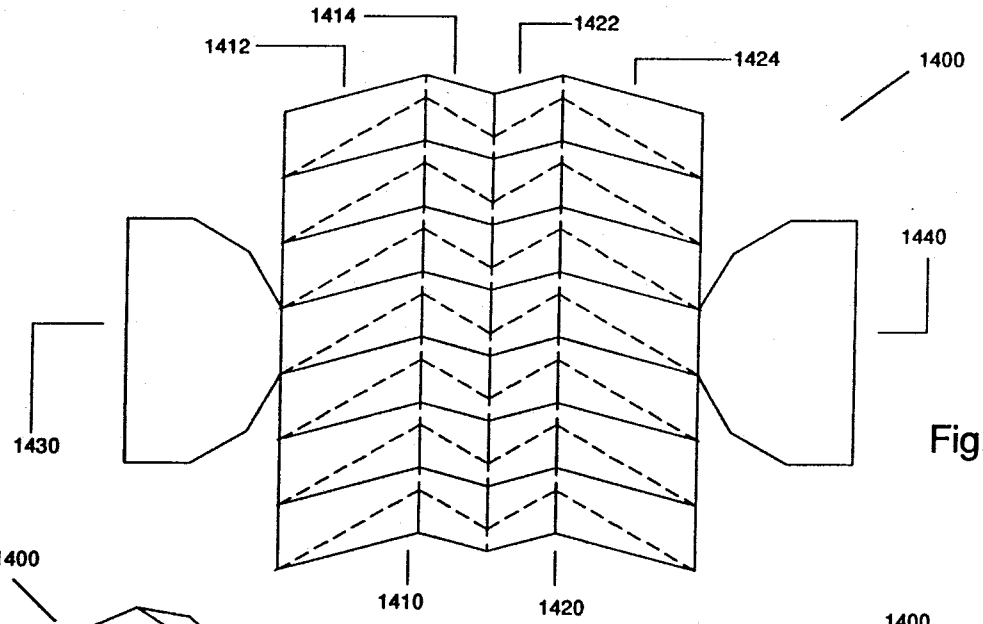
FIG. 54 is a plan view of a structure that is another embodiment of the invention.

In FIG. 54 structure 1400 is comprised of units 1410 and 1420 in combination with end pieces 1430 and 1440. Structure 1400 is shown in a flat and unfolded configuration. Unit 1410 is made up of strips 1412 and 1414. Similarly unit 1420 is made up of strips 1422 and 1424. Unit 1410 is connected to adjacent unit 1420 by a series of connecting pleat lines that are connected end-to-end.

Figure 55:
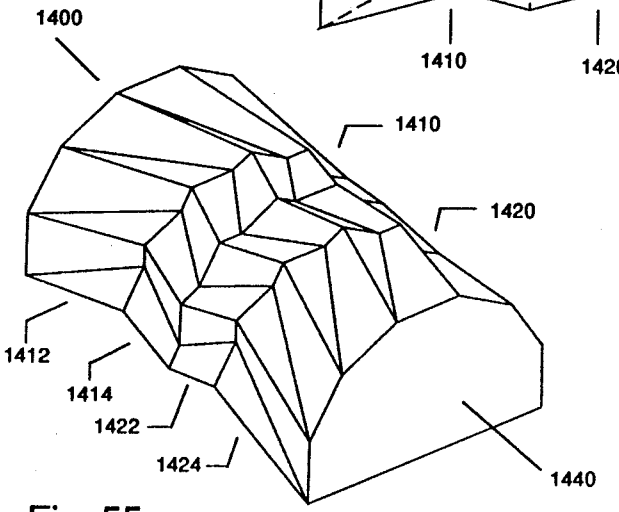

In FIG. 55 the structure 1400 is shown in partially folded. The surface formed has a curvature running along the lengths of the units 1410 and 1420. End piece 1440 may be seen to have been joined continuously along the edge of unit 1420. Likewise, end piece 1430 has been joined continuously along the edge of unit 1410.

Figure 56:
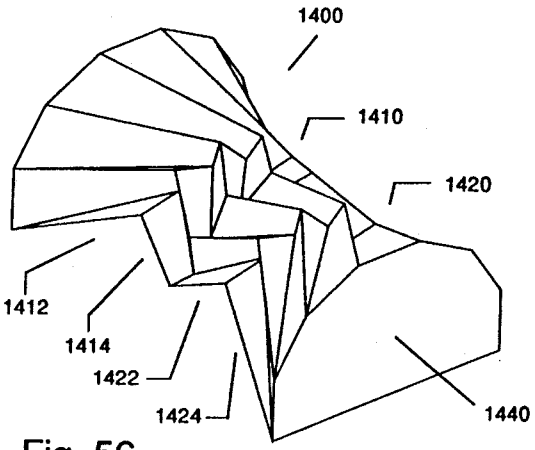
FIGS. 55–57 are perspective views of the structure (shown in FIG. 54), which has the form of a half-cylinder with enclosed ends, as it is folded down to its completely collapsed state.
Figure 57:
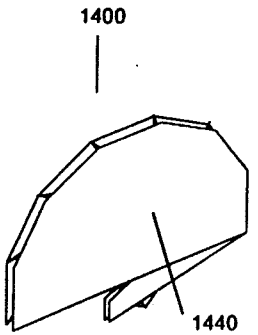

In FIG. 56 the structure 1400 is shown folded to a further degree than in FIG. 57. The strips 1412, 1414, 1422 and 1424 may be seen to fold towards each other. The overall curvature of unit 1400, as shown in FIG. 56, is essentially the same as its curvature when folded to a lesser degree, as shown in FIG. 55. End pieces 1430 and 1440 remain joined continuously along the edges of units 1410 and 1420 respectively.

In FIG. 57 the structure 1400 is shown in fully folded configuration. Units 1410 and 1420 are essentially stacked one over the other. The overall curvature of unit 1400, as shown in FIG. 57, remains essentially the same as its curvature when folded to a lesser degree, as shown in FIG. 56 and FIG. 55.

In order to cause structure 1400 to transform from its partially folded state, as shown in FIG. 55, to its fully folded state, shown in FIG. 57, all that is required is that the two end pieces 1430 and 1440 be pushed together with a simple straight-line motion.

It will be appreciated that the instant specification and claims are set forth by way of illustration and not limitation, and that various modifications and changes may be made without departing from the spirit and scope of the present invention.

What is claimed is:

1. An expandable structure comprised of at least two strips, each strip being pleated along a series of lines that cross it widthwise, the fold directions of said adjacent crossing lines alternating, the angles formed by some of the crossing lines with the strip's edge being different from the similarly formed angles of their adjacent crossing lines, thereby forming a series of facets that include triangles, trapeziums or trapezoids, each strip being joined to the other by a series of pleat lines that are connected end-to-end, and the fold directions of said adjacent connecting lines alternating, the structure in expanded state forming a surface having curvature oriented lengthwise along the strips, the structure in folded state having the two strips essentially flattened against each other, whereby as the structure is changed from an expanded to folded state, the curvature remains essentially the same.

2. An expandable structure according to claim 1, where a flat sheet is attached continuously along at least one of the edges of a strip.

3. An expandable structure according to claim 1., wherein one end of each strip is joined to its other end so that a loop is formed, the loop in collapsed condition serving to flatten the strips against each other.

4. An expandable structure according to claim 3., where a flat sheet is attached continuously along at least one of the edges of the loop.

5. A expandable structure according to claim 3, wherein as the loop is folded, flattening the strips against each other, at least one secondary fold is introduced, such that the loop is folded in a zig-zag fashion thereby reducing its packaged size.

6. An expandable structure according to claim 5, where a flat sheet is attached continuously along at least one of the edges of the loop.

7. A expandable structure according to claim 1, wherein as the structure is folded, flattening the strips against each other, at least one secondary fold is introduced, such that the structure is folded in a zig-zag fashion thereby reducing its packaged size.

8. An expandable structure according to claim 7, where a flat sheet is attached continuously along at least one of the edges of the structure.

* * * * *